United States Patent [19]

Meny et al.

[11] 4,437,793

[45] Mar. 20, 1984

[54] PROTECTING MEANS

[76] Inventors: Allan H. Meny, 1 Hoover St., North Arlington, N.J. 07032; Dennis L. Palmer, 61 Douglas Dr., Towaco, N.J. 07082

[21] Appl. No.: 374,731

[22] Filed: May 4, 1982

[51] Int. Cl.[3] ..... E02B 3/22

[52] U.S. Cl. ..... 405/212; 114/219; 405/211

[58] Field of Search ..... 405/211-216; 114/219, 220; 14/76; 267/140, 141, 139

[56] References Cited

U.S. PATENT DOCUMENTS

| | | | |
|---|---|---|---|
| 1,266,050 | 5/1918 | Reynolds | 405/211 |
| 1,279,732 | 9/1918 | Lockwood | 405/211 |
| 3,292,566 | 12/1966 | Russell | 114/219 |
| 3,540,403 | 11/1970 | Russell | 405/212 X |
| 3,593,531 | 7/1971 | Saadeh | 405/212 |
| 4,295,758 | 10/1981 | Yashima | 405/211 X |
| 4,300,855 | 11/1981 | Watson | 405/211 X |

FOREIGN PATENT DOCUMENTS

| | | | |
|---|---|---|---|
| 725965 | 10/1942 | Fed. Rep. of Germany | 405/212 |
| 28934 | 2/1933 | Netherlands | 405/212 |

*Primary Examiner*—Dennis L. Taylor
*Attorney, Agent, or Firm*—Bernard J. Murphy

[57] ABSTRACT

In an embodiment of the invention as depicted, buoyant flotation devices are tethered in a spaced-apart circumjacency to a water-bound and partially water-submerged object, to protect the object from ice-caused or impact-caused damage. The flotation devices are of sufficient number and in sufficient proximity to each other, to define a water-surface area about the object which is substantially closed. The devices are yieldable, to allow an ice formation to insinuate itself or expand the defined area, and freely deform if impacted by a floating article or vessel. In further embodiments of the invention, an area-shrouding canopy is secure to the to-be-protected object and to the flotation devices, to establish and maintain a temperature difference, within the shrouded area, over that which obtains outside of the shroud or canopy. Also, conduits coupled to the flotation devices promote a water current flow, between lower water depths and upper depths, again to establish and maintain such an aforesaid temperature difference within the defined area.

11 Claims, 12 Drawing Figures

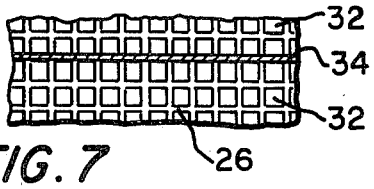
FIG. 7
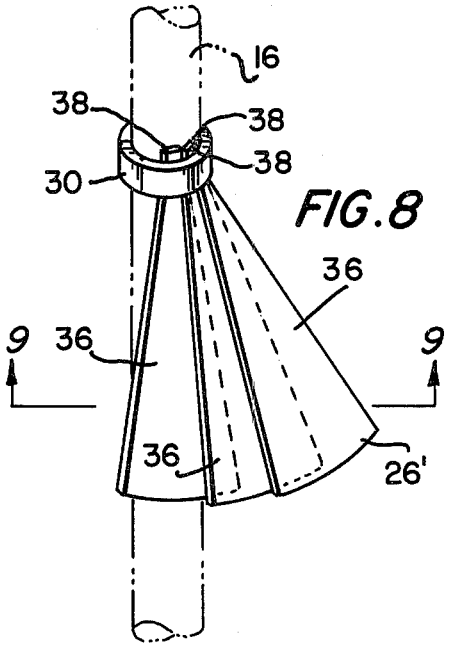
FIG. 8
FIG. 9
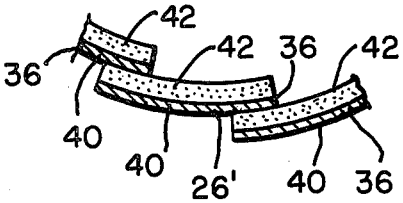
FIG. 10
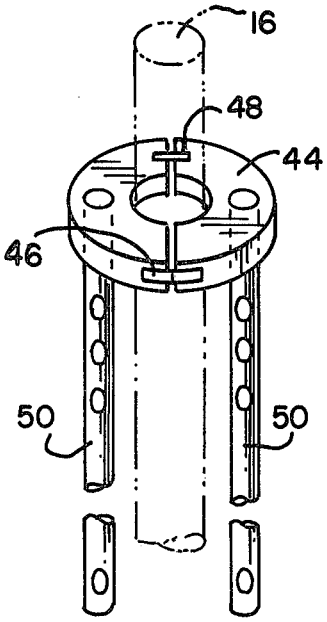
FIG. 12
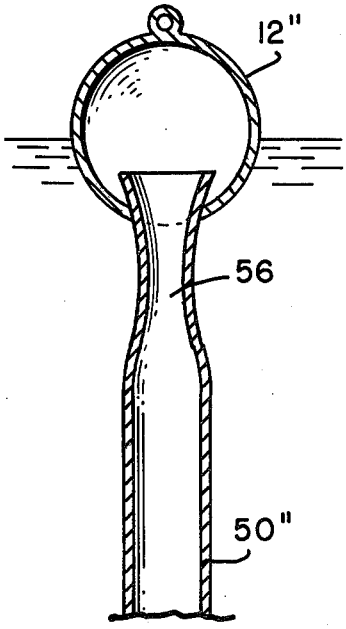
FIG. 11
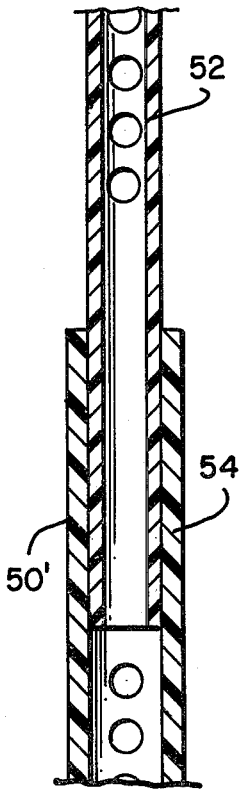

PROTECTING MEANS

This invention pertains to protecting means, and in particular to protecting means for a water-bound object, such as a boat, pile, or the like, for fending off incursions of ice formations or impacts from floating articles or vessels.

Protecting means of the type to which the invention pertains, and which are known in the prior art, have given disadvantages. Either they are expensive of manufacture and maintenance, or they are of predetermined configuration and size and require immobile clamping thereof to the object to be protected.

It is an object of this invention to set forth a protecting means of the aforesaid type which is economical of manufacture, and of universal use.

It is particularly an object of this invention to disclose means for protecting a water-bound and partially water-submerged object, such as a boat, pile, float, pillar, or the like, from ice- or impact-caused damage, comprising: means for buoyant flotation thereof substantially upon the surface of water; and means for coupling said flotation means in spaced-apart circumjacency to such object; wherein said flotation means comprises means (a) for defining a substantially closed, water-surface area about such object, and (b) which is yieldable, (1) in response to a pressured engagement thereof by an ice formation, to enlarge said area, and (2) to exhibit deformation upon being impacted.

Further objects of this invention, as well as the novel features thereof, will become more apparent by reference to the following description, taken in conjunction with the accompanying figures, in which:

FIG. 7 is a cross-sectional view taken along section 7—7 of FIG. 6;

FIG. 8 is a fragmentary view of a portion of an alternative shroud;

FIG. 9 is a cross-sectional view taken along section 9—9 of FIG. 8;

FIG. 10 is a perspective view of a water-current inducing conduit assembly;

FIG. 11 is a fragmentary cross-section of an alternative, extensible conduit usable with the assembly of FIG. 10; and FIG. 12 is a partial, cross-sectional view of yet another alternative conduit.

Figure 1:
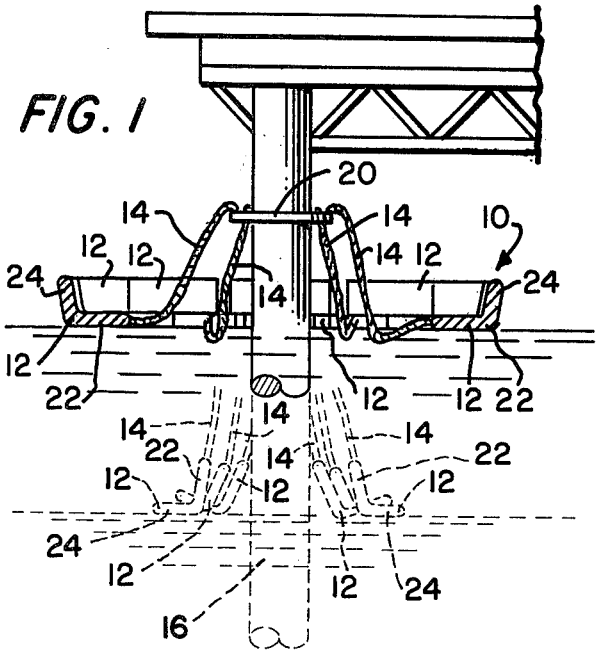
FIG. 1 is a view of a first embodiment of the invention, the same taken along section 1—1 of FIG. 2, as well as a low tide disposition thereof.
Figure 2:
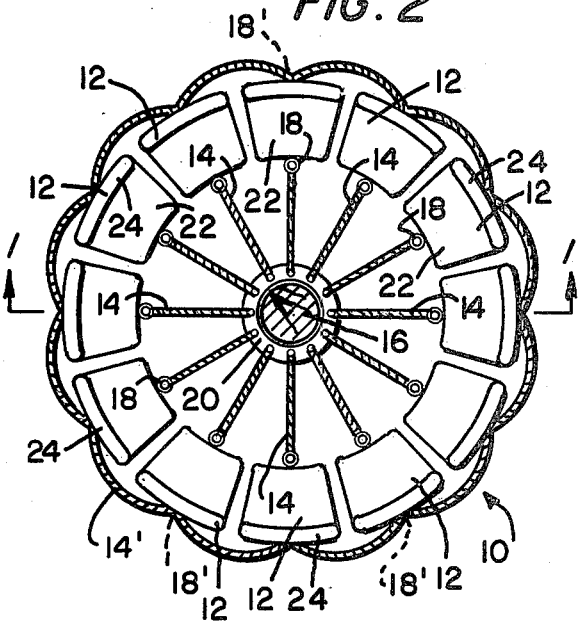
FIG. 2 is a plan view, showing a to-be-protected pillar in cross-section, of the FIG. 1 embodiment at high tide.
Figure 3:
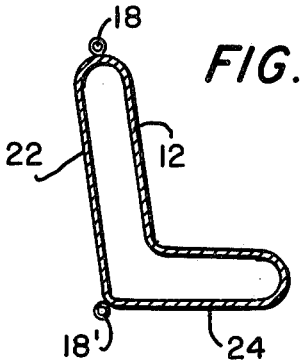
FIG. 3 is a cross-sectional view, in vertical depiction, of one of the flotation devices of FIGS. 1 and 2.

As shown in FIGS. 1-3, a first embodiment 10 of the novel protecting means comprises a plurality of flotation devices 12. Each of the devices 12 is tethered, by a line 14, to a to-be-protected pillar 16, which is secured to an eye 18. By means of a second eye 18', carried by each of the devices 12, all thereof are lashed together by an outer, peripheral line 14'. All of the lines 14 are held by a pillar-encircling clamp 20.

FIG. 2, and the uppermost illustration shows the protecting means 10 in its normal disposition during a high tide condition. The flotation devices 12 each have a primary flotation surface 22, upon which the same is buoyant during the aforesaid high tide condition, and a secondary flotation surface 24 upon which the same is buoyant during a low tide condition (shown in the lowermost illustration in FIG. 2). During such low tide condition, the devices tip, to float on the secondary surfaces 24, and cluster in some close, interfering jumble. Under either condition, however, the plurality of tethered devices 12 define a substantially closed, water-surface area about the pillar 16.

In the embodiment shown, the devices 12 are air-filled. However, they could be filled with any lighter-than-water fluid; too they may be kapok-filled, or have therewithin, or be formed of, cork, or the like. It is only a condition of the invention that the devices 12 by yieldable upon being pressured by a formation of ice and be capable of deformation when impacted by a floating object or vessel. Under the first circumstance, where ice proceeds to form within the area bounded by the devices, the ice formation will exert a pressure—centrally of the area, whereat the pillar 16 is sited, and outwardly therefrom. Of course, the devices 12 will yield, and deform, to allow the ice to expand outwardly of the bounded area. Additionally, with a tidal movement occurring, after there having been an ice formation within the bounded area, the devices 12, again, will deform and flex, and fragment the ice fully about the periphery of the bounded area. If a formation of ice clings to the pillar 16, it shall have been separated from any ice formation outside of the bounded area, due to the compliant flexure and deformation of the devices 12. Such pillar-clinging ice will simply be suspended, peripherally, upon the pillar 16, when the water level decreases to a low tide condition, or become immersed upon the water level increasing under high tide. The devices define a compliant, flexible wall, between the bound area, and the water surface outside of the bound area. Hence, a crushing, continous mass of ice can not traverse the flexible wall—presented by the circumjacent devices 12—to close in on, and damage the protected object (i.e., the pillar 16, here). Pillars, piers, docks, boats, etc. are subject to such damage due to the formation of a great mass of continous ice, the latter expanding, and pushing itself against the objects by pressure-reaction from the mass thereof therebehind. The flotation devices 12 break that continuity of ice mass; ice forming about a protected object has no mass thereof therebehind from which to react with damaging pressure. The flexible wall of flotation devices simply yields under the pressure, and thus save the protected object from damage. Under the most severe, frigid conditions, a formation of ice within the devices-bound area will simply proceed to migrate into and upon the devices 12; so also with the ice mass outside the devices-bound area—it will intrude upon and into the devices. Some of the devices may even be pushed into total submersion. Even so, the compliance of the devices 12 will insure a "break" between the formation of ice within the area, and that outside thereof.

For defining a buoyant wall, around such object to be protected, i.e., the pillar 16, it is self-evident that the devices 12 will fend off any impacts from floating objects or vessels. Depending upon the force of the impact, and the construction of the devices 12, the latter may be slightly damaged, or wholly destroyed. In the latter case, it is a simple matter to replace any thereof which are no longer functional—as, for being punctured, if air-filled, or fragmented, if formed of cork, or the like. However, damage to one of the devices—or a few thereof—is an easy price to pay for protection of an expensive dock or boat. Too, the individual devices are of simple and inexpensive manufacture. It is an easy chore to replace any one thereof, as well. Further, until a replacement (or replacements) for the damaged device 12 is obtained, it is necessary only to close-up the array thereof into a smaller circle; the remaining devices can be lashed into a smaller diameter by taking up on the peripheral line 14'. The basic protection of the novel means 10 is not significantly diminished by the loss of one or more devices 12.

Figure 4:
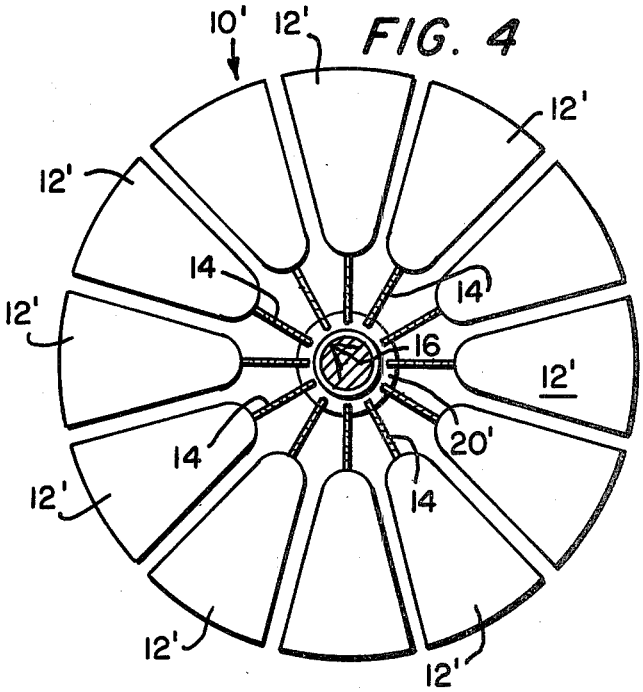
FIG. 4 is a plan view of an alternative embodiment of the invention, the same being similar to the FIG. 2 illustration.
Figure 5:
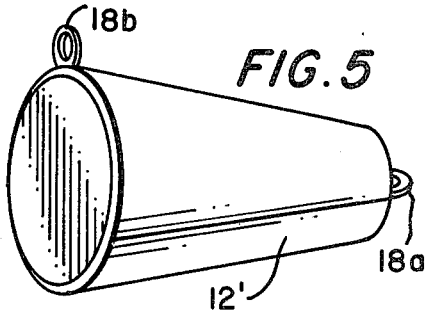
FIG. 5 is a perspective view of one of the flotation devices of the FIG. 4 embodiment of the invention.

FIGS. 4 and 5 depict an alternative embodiment 10' of the invention in which the flotation devices 12' are tapered, having tethering eyes 18*a* at one end thereof, and coupling eyes 18*b* at the opposite end thereof. Due to the tapered configuration thereof, devices 12' cluster into a rather impervious wall when, at a low tide condition, they tilt and float upon the larger-diameter ends thereof.

Figure 6:
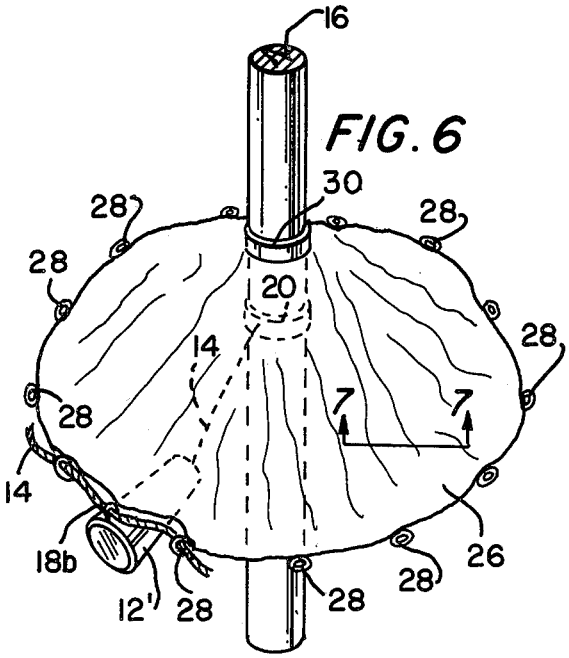
FIG. 6 is also a perspective view of the embodiment of FIGS. 4 and 5 which, in addition, employs a shroud.

The embodiment 10' of FIGS. 4 (and 5) is used, as shown in FIG. 6, with a shrouding canopy 26. The canopy 26 carries grommets 28 about the periphery thereof, and these grommets are employed to receive the peripheral, lashing line 14'. The center of the canopy 26 is clasped about the pillar 16 by means of a collar 30. Now, while only one of the flotation devices 12' is shown, it will be evident that, in this practice of the invention, the full array of such devices are set out below the canopy 26.

In this embodiment, the canopy 26 is formed of flexible, insulating material. The material comprises air-filled voids in a pair of "space" blankets 32 which confine therebetween a durable sheet of canvas 34. The canopy 26 shrouds the area, circumscribing the pillar 16, which is defined by the flotation devices 12', to establish and maintain a temperature difference therewithin over that which obtains outside thereof. For example, the canopy 26 shields the area bound by the flotation devices 12' from wind chill—which is a principal cause of ice formation. Additionally, the outer surface of the shroud or canopy 26 is of dark color—to absorb solar rays, and pass the heat component thereof through the air-filled voids and canvas into the devices-bound area. The canopy 26 is secured to the pillar 16 at an elevation above the tether clamp 20 for two reasons: this is to insure that the shrouding will not interfere with the lines 14, and to define a pitched configuration of the canopy. The latter contributes to a sloughing-off of snow, hail, rain and such precipitation.

FIGS. 8 and 9 depict an alternative version of a canopy 26' formed of substantially firm segments 36. Each segment 36 has a narrow, flexible end 38 which is held fast to the pillar 16 by the collar 30, and a widened end, opposite thereto, which is overlapped by an adjacent segment 36. While not shown, the widened ends of the segments 36 are also lashed to flotation devices 12' (or 12). At high tide, the segments fan out, and at low tide, they close up. Each segment 36 has an outer shell 40 of dark-colored metal to which is bonded an insulation 42.

In FIGS. 10 and 11 are depicted further means for establishing and maintaining a favorable temperature within the flotation devices defined area. A flotation collar 44 having a pair of halves, joined by a hinge 46 and secured by a latch 48, suspends therefrom a pair of conduits 50. The collar 44 has an inside diameter which is greater than the outside diameter of the pillar 16 and, as a consequence, is free to float up and down along the pillar 16. The conduits 50 have apertures formed therein adjacent to the opposite ends thereof to induce a water-current flow from lower water depths to upper water depths. In this manner, the conduits 50 carry "warmer", lower-depth water to the surface area to frustrate the formation of ice. The conduits are impervious, intermediate the length thereof, to shunt across "intermediate" temperature water. In its free state, water has such temperature differences. However, in a great multiplicity of levels thereof, the temperature differences exhibit minute, light current flows, from one level to another thereadjacent. Hence, from the water surface to the bottom of the lake or river, or whatever, there is no temperature-flow exchange; i.e., there is no overall mass exchange from the bottom to the top, or vice versa. There are simply a multiplicity of slight exchanges all along the depth of the water. The conduits 50, however, put the "warmer", lower-depths water in direct confrontation with the "colder" surface water. Now, as the two water components tend to move in opposite directions, the latter tending to sink, and the former tending to rise, it would seem that no flow will ensue. However, as the lower, "warmer" water is under greater pressure, it overcomes the balance which would otherwise obtain, and proceeds up the conduits 50. The "colder" water in the top of the conduits 50 is displaced and descends toward lower depths.

Where the water depth requires some adjustment of the conduit length, telescoping conduits, such as conduit 50' may be employed. The latter comprises a pair of concentrically-engaging pipes 52 and 54. The pipes are in an interference fit, so it is only necessary to move the two relative to each other to elongate or foreshorten the conduit 50'.

To revert to the water-current flow, FIG. 12 depicts a further alternative embodiment of a conduit 50'' secure to a flotation device 12''. Here, the conduit 50'' has the upper, open end thereof held below the surface of the water—by the device 12''—and is formed with a venturi throat 56. The throat 56 defines a constriction which reduces the pressure of the water passing therethrough and, consequently, accommodates an enhanced, accelerated flow of water therethrough.

Now, while I have described my invention in connection with specific embodiments thereof, it is to be clearly understood that this is done only by way of example, and not as a limitation to the scope of my invention as set forth in the objects thereof and in the appended claims. For instance, it will be understood that fluids, kapok and cork are not exhaustive of the substances which may be used to define the flotation devices 12, 12' or 12''. Neither are the latter devices exemplary of all possible configurations thereof. The canopies 26 and 26' simply illustrate two possible types which may be used. Surely, by taking teaching from my disclosure, others will appreciate how else such may be formed and deployed. My invention comprises all alternative embodiments of the devices, canopies, and conduits, as fall within the ambit of my claims, and proceed from by disclosure.

I claim:

1. Means for protecting a water-bound and partially water-submerged object, such as a boat, pile, float, pillar, or the like, from ice- or impact-caused damage, comprising:

means for buoyant flotation thereof substantially upon the surface of water; and means for coupling said flotation means in spaced-apart circumjacency to such object; wherein said flotation means comprises means (a) for defining, and substantially circumscribing, a water-surface area which is exposed to the ambient atmosphere about such object, and (b) which is yieldable, (1) in response to a pressured engagement thereof by an ice formation, to enlarge said area, and (2) to exhibit resilient deformation upon being impacted; and said flotation means comprises a plurality of individual flotation devices, each one of said flotation devices having means for tethering thereof separately to such object.

2. Protecting means, according to claim 1, wherein:

said flotation devices further comprise means which, in response to (a) tidal excursions of water, and (b) an immobility of the object, fragment any such ice formation in engagement therewith.

3. Protecting means, according to claim 1, further including:

conduit means, for disposition thereof in immediate adjacency to said object, for communicating water at a first given level with water at a second given level, in shunting bypass of water which is intermediate said first and second levels, to induce an ice-formation frustrating water current about said object and within said area.

4. Protecting means, according to claim 1, further including:

means for fastening to such object for shrouding substantially all of said area from the ambient atmosphere.

5. Protecting means, according to claim 1, wherein:

said devices each have a primary flotation surface for use during one tidal condition, and a secondary flotation surface during an alternative tidal condition.

6. Protecting means, according to claim 1, wherein:

each of said devices confines therewithin a fluid which is lighter than water.

7. Protecting means, according to claim 3, wherein:

said conduit means comprises at least one conduit having at least one aperture opening thereinto in adjacency to one end thereof, having at least one aperture opening thereinto in adjacency to the opposite end thereof, and being imperforate intermediate the length thereof; and said conduit means further comprises means for buoyantly suspending said one conduit, substantially vertically, in immediate adjacency to said object, and for constraining said conduit means from substantial movement away from said object.

8. Protecting means, according to claim 4, wherein:

said shrouding means comprises means defining a canopy; and said canopy having means for attachment thereof to said flotation means.

9. Protecting means, according to claim 8, wherein:

said canopy is formed of flexible material.

10. Protecting means, according to claim 8, wherein:

said canopy comprises a plurality of overlying and mutually slidable segments.

11. Protecting means, according to claim 3, wherein:

said conduit means has a venturi-type constriction, intermediate the length thereof, to reduce pressure of the water current therewithin and to accommodate an enhanced flow of water therethrough.

* * * * *

UNITED STATES PATENT AND TRADEMARK OFFICE

Certificate

Patent No. 4,437,793 Patented March 20, 1984

Allan H. Meny and Dennis L. Palmer

Application having been made by Allan H. Meny and Dennis L. Palmer, the inventors named in the patent above identified, for the issuance of a certificate under the provisions of Title 35, Section 256, of the United States Code, deleting the name of Dennis L. Palmer as a joint inventor, and a showing and proof of facts satisfying the requirements of the said section having been submitted, it is this 9th day of Oct., 1984, certified that the name of the said Dennis L. Palmer is hereby deleted from the said patent as a joint inventor with the said Allan H. Meny and Dennis L. Palmer.

Fred W. Sherling,
*Associate Solicitor.*